US011352819B2

(12) United States Patent
Yokota et al.

(10) Patent No.: US 11,352,819 B2
(45) Date of Patent: Jun. 7, 2022

(54) DOOR LOCK DEVICE

(71) Applicant: MITSUI KINZOKU ACT CORPORATION, Kanagawa (JP)

(72) Inventors: Yoshiaki Yokota, Kanagawa (JP); Naoto Fujiwara, Kanagawa (JP); Makoto Kondo, Kanagawa (JP)

(73) Assignee: MITSUI KINZOKU ACT CORPORATION, Kanagawa (JP)

( * ) Notice: Subject to any disclaimer, the term of this patent is extended or adjusted under 35 U.S.C. 154(b) by 342 days.

(21) Appl. No.: 16/735,540

(22) Filed: Jan. 6, 2020

(65) Prior Publication Data

US 2020/0224463 A1 Jul. 16, 2020

(30) Foreign Application Priority Data

Jan. 11, 2019 (JP) ..... JP2019-003348

(51) Int. Cl.

| | |
|---|---|
| ***E05B 79/04*** | (2014.01) |
| ***E05B 81/16*** | (2014.01) |
| ***E05B 15/16*** | (2006.01) |
| ***E05B 81/34*** | (2014.01) |

(52) U.S. Cl.

CPC ..... *E05B 79/04* (2013.01); *E05B 15/1635* (2013.01); *E05B 81/16* (2013.01); *E05B 81/34* (2013.01); *E05Y 2900/531* (2013.01)

(58) Field of Classification Search

CPC ..... E05B 79/04; E05B 79/08; E05B 79/10; E05B 81/00; E05B 81/06; E05B 81/04; E05B 81/16; E05B 81/34; E05B 15/1635; E05B 17/0029; Y10S 292/23; Y10S 292/64; Y10S 292/55; Y10S 292/53; E05Y 2900/531

USPC ..... 292/201, 216

See application file for complete search history.

(56) References Cited

U.S. PATENT DOCUMENTS

| | | | | |
|---|---|---|---|---|
| 8,833,808 | B2 * | 9/2014 | Watanabe | E05B 85/02 292/201 |
| 9,670,701 | B2 * | 6/2017 | Okawa | E05B 81/15 |
| 2002/0117862 | A1 * | 8/2002 | Yamauchi | E05B 81/20 292/216 |

(Continued)

FOREIGN PATENT DOCUMENTS

| | | | |
|---|---|---|---|
| JP | 4691412 | B2 | 6/2011 |
| JP | 2018184720 | A * | 11/2018 |

*Primary Examiner* — Kristina R Fulton
*Assistant Examiner* — James Edward Ignaczewski
(74) *Attorney, Agent, or Firm* — McDermott Will & Emery LLP

(57) ABSTRACT

A door lock device including: a latch; a ratchet; an output shaft configured to rotate by a motor; an output lever configured to move the latch from a half latch position to a full latch position when the output shaft is rotated in a normal direction, and to release an engagement of the ratchet to the latch when the output shaft is rotated in a reverse direction; a first metal bracket including a first shaft support hole configured to rotatably support the output shaft; and a second metal bracket including a second shaft support hole configured to rotatably support the output shaft at a location different from that of the first shaft support hole, wherein the first metal bracket and the second metal bracket are fixed to each other by two or more screw holes of the first metal bracket and two or more holes of the second metal bracket.

11 Claims, 12 Drawing Sheets

(56) References Cited

U.S. PATENT DOCUMENTS

| | | | | |
|---|---|---|---|---|
| 2008/0073917 | A1* | 3/2008 | Ciavaglia | E05B 81/20 292/201 |
| 2008/0252083 | A1* | 10/2008 | Carabalona | E05B 81/20 292/49 |
| 2012/0161454 | A1* | 6/2012 | Muramatsu | E05B 77/36 292/141 |
| 2014/0252783 | A1* | 9/2014 | Yokota | E05B 81/74 292/196 |

* cited by examiner

DOOR LOCK DEVICE

The present application claims priority to and incorporates by reference the entire contents of Japanese Patent Application No. 2019-003348 filed in Japan on Jan. 11, 2019.

BACKGROUND

The present disclosure relates to a door lock device.

A door lock device for a vehicle is provided on a door, and locks the door by holding a striker provided on the vehicle body side by a latch mechanism.

For example, in a door lock device used for a back door of a vehicle, when the back door is to be closed, the motor is rotated in the normal direction at a stage when the positional relation between the door lock device and the striker is in the half latch position. Consequently, the output shaft driven by the motor rotates the lever in the normal direction, and allows the latch to automatically move to the full latch position (for example, see Japanese Patent No. 4691412). When the door is to be opened, the motor is rotated in the reverse direction, the output shaft rotates the lever in the reverse direction, and the engagement of the latch to the ratchet is released. The door lock device includes a metal bracket as a base. The metal bracket has sufficient rigidity as a rigid member.

Similarly to other vehicle components, weight reduction of the door lock device has been desired. Because large force is applied to the door lock device in accordance with the weight and the closing action speed of the door, the shaft support part of the output shaft, in particular, needs to be very rigid. However, for example, when reducing the weight of the metal bracket by changing the shape or thickness thereof, it may be impossible to provide the necessary rigidity to the metal bracket.

SUMMARY

In some embodiments, a door lock device according to the present disclosure includes: a latch configured to hold a striker; a ratchet configured to engage the latch at a half latch position and at a full latch position; an output shaft configured to rotate in a normal direction and in a reverse direction by a motor; an output lever unrotatably connected to the output shaft, the output lever being configured to move the latch from the half latch position to the full latch position when the output shaft is rotated in the normal direction, and to release an engagement of the ratchet to the latch when the output shaft is rotated in the reverse direction; a first metal bracket including a first shaft support hole configured to rotatably support the output shaft; and a second metal bracket including a second shaft support hole configured to rotatably support the output shaft at a location different from that of the first shaft support hole, wherein the first metal bracket and the second metal bracket are fixed to each other by two or more screw holes of the first metal bracket and two or more holes of the second metal bracket.

The above and other objects, features, advantages and technical and industrial significance of this disclosure will be better understood by reading the following detailed description of presently preferred embodiments of the disclosure, when considered in connection with the accompanying drawings.

DETAILED DESCRIPTION

Hereinafter, an embodiment of a door lock device according to the present disclosure will be described in detail with reference to the accompanying drawings. However, the present disclosure is not limited to this embodiment.

Figure 1:
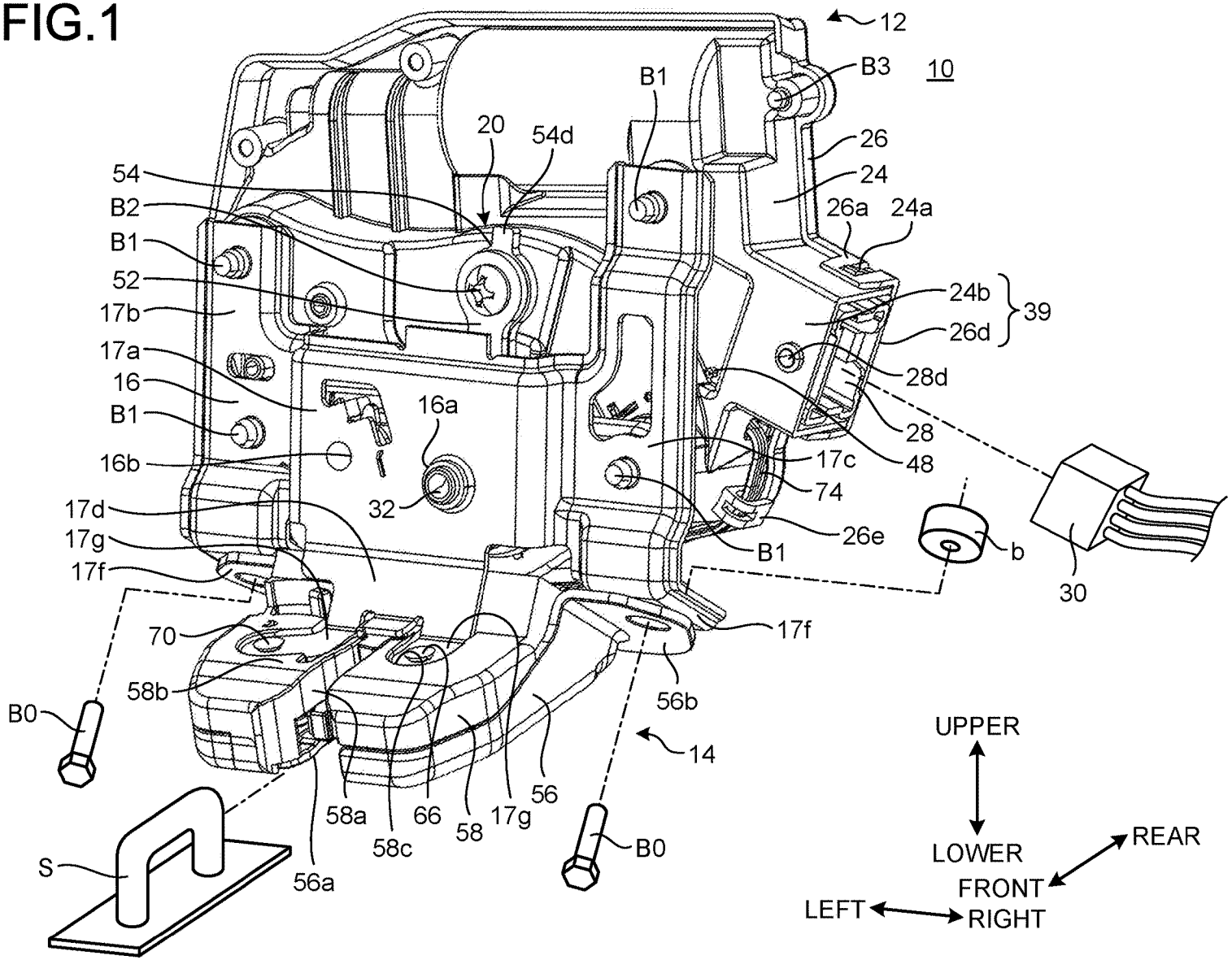
FIG. 1 is a perspective view of a door lock device according to an embodiment when viewed from the obliquely front side.
Figure 2:
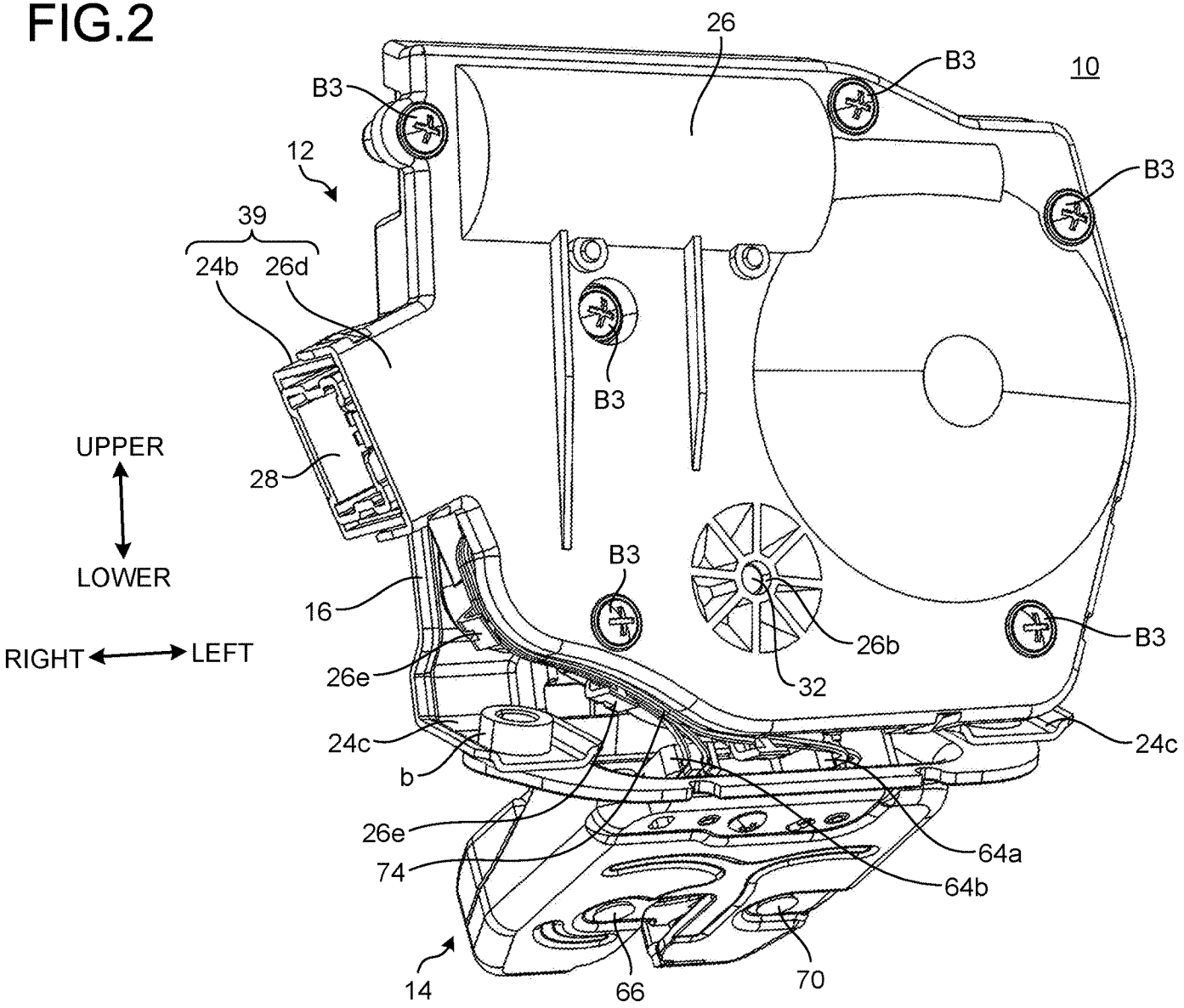
FIG. 2 is a perspective view of the door lock device according to the embodiment when viewed from the obliquely rear side.
Figure 3:
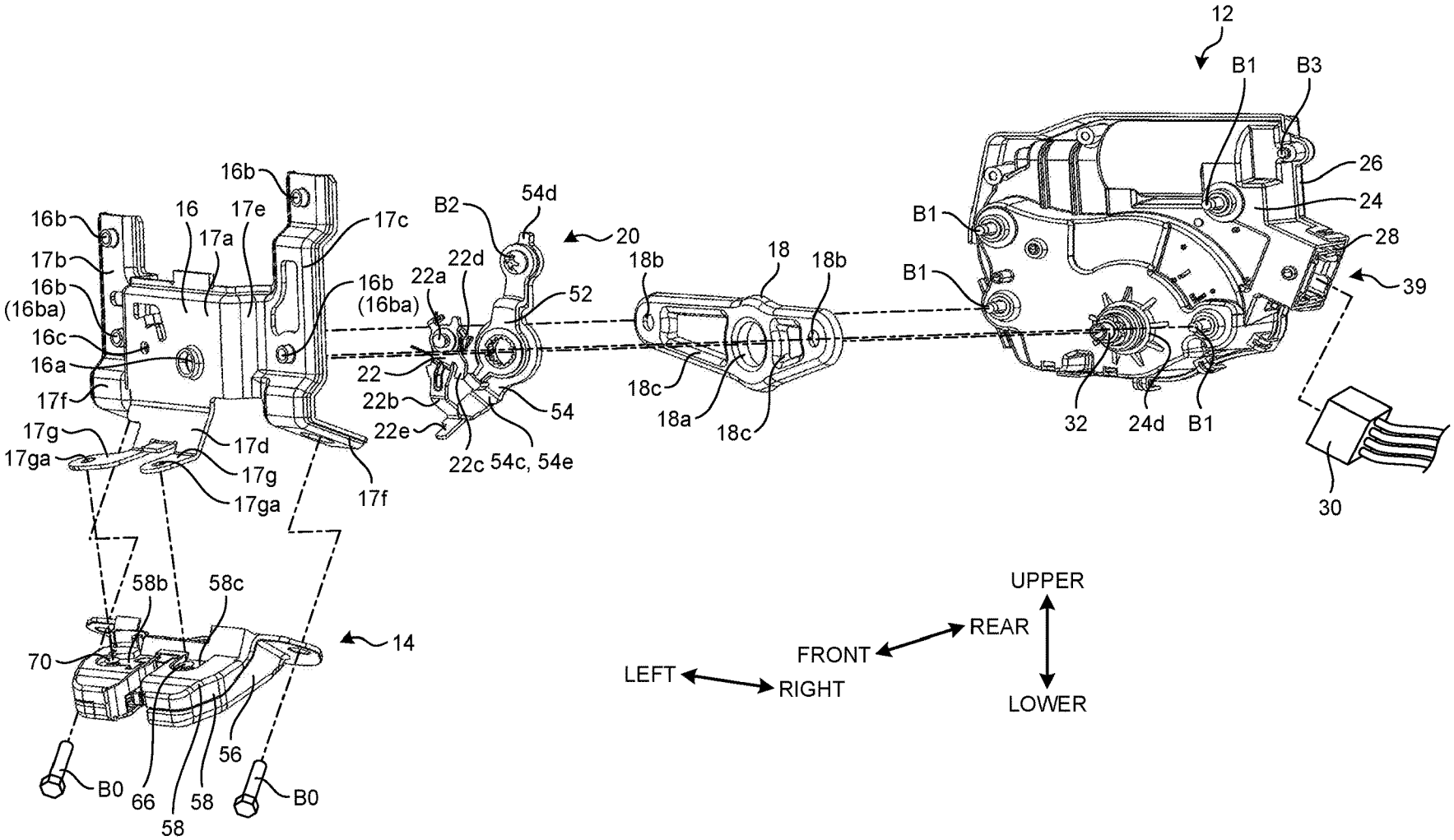
FIG. 3 is an exploded perspective view of the door lock device according to the embodiment.

FIG. 1 is a perspective view of a door lock device 10 according to the embodiment when viewed from the obliquely front side. FIG. 2 is a perspective view of the door lock device 10 according to the embodiment when viewed from the obliquely rear side. FIG. 3 is an exploded perspective view of the door lock device 10 according to the embodiment. For example, the door lock device 10 is fixed to a back door of a vehicle with a bolt B0 via a bush b. The door lock device 10 locks the back door by holding a striker S provided on the vehicle body side. In the following explanation in FIG. 1 to FIG. 3, the near side is referred to as a front side, and the far side is referred to as a rear side.

As illustrated in FIG. 1 to FIG. 3, the door lock device 10 includes a motor unit 12, a latch unit 14, a first metal bracket 16, and a second metal bracket 18. In the door lock device 10, the first metal bracket 16 is a base member that has adequate rigidity, and the motor unit 12 and the latch unit 14 are fitted to the first metal bracket 16. The motor unit 12 and the latch unit 14 may not be independent units. The door lock device 10 also includes a lever assembly 20 and an open lever 22, between the first metal bracket 16 and the second metal bracket 18.

First, the motor unit 12 will be described. As illustrated in FIG. 3, in the motor unit 12, a housing is formed by a front housing (resin housing) 24 at the front side and a rear housing (resin housing) 26. The housing has waterproof and dustproof functions with respect to the components inside. In this example, the "waterproof" also means drip-proof in addition to complete waterproof.

The rear housing 26 includes five engaging claws 26*a* at the side and lower part. The front housing 24 includes five engagement projections 24*a* corresponding to the five engaging claws 26*a*. The rear housing 26 is fixed to the front housing 24 when the engaging claws 26*a* are engaged with the respective engagement projections 24*a* in a snap-fit manner. In this manner, a set of the engagement projection 24*a* and the engaging claws 26*a* forms a housing interlocking part. The front housing 24 and the rear housing 26 are also fastened by six bolts B3 (see FIG. 2). The front housing 24 and the rear housing 26 are made of resin, and are light in weight.

A coupler 28 is provided at the side of the motor unit 12. A harness connector 30 is connected to the coupler 28. The harness connector 30 is linked to a control unit, which is not illustrated. The motor unit 12 includes an output shaft 32 that projects forward from a part slightly lower than the center of the front housing 24 at the front side. The motor unit 12 rotates the output shaft 32 in the normal direction and in the reverse direction under the action of the control unit. The output shaft 32 rotates the lever assembly 20 (see FIG. 6), which will be described below, in the normal direction and in the reverse direction. The motor unit 12 is fixed to the first metal bracket 16, when four bolts B1 that each project from the front housing 24 toward the front side are respectively screwed into four screw holes 16*b* on the first metal bracket 16. Two of the lower bolts B1 among the four bolts B1 pass through holes 18*b* of the second metal bracket 18, and are fastened together with the second metal bracket 18. In other words, the second metal bracket 18 is held and fixed between the front housing 24 and the first metal bracket 16.

Figure 4:
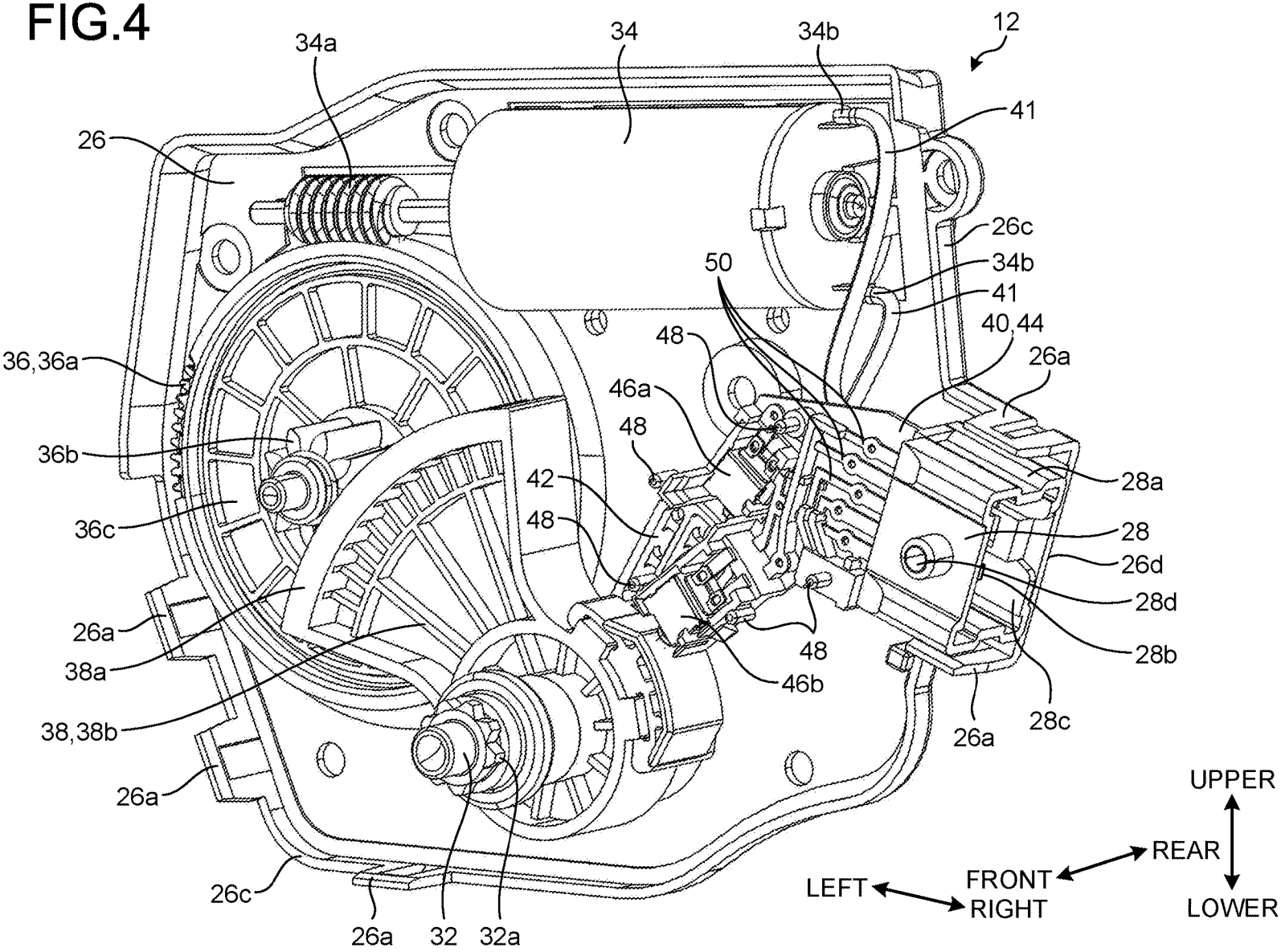
FIG. 4 is a perspective view of the inside of a motor unit when viewed from the obliquely front side.
Figure 5:
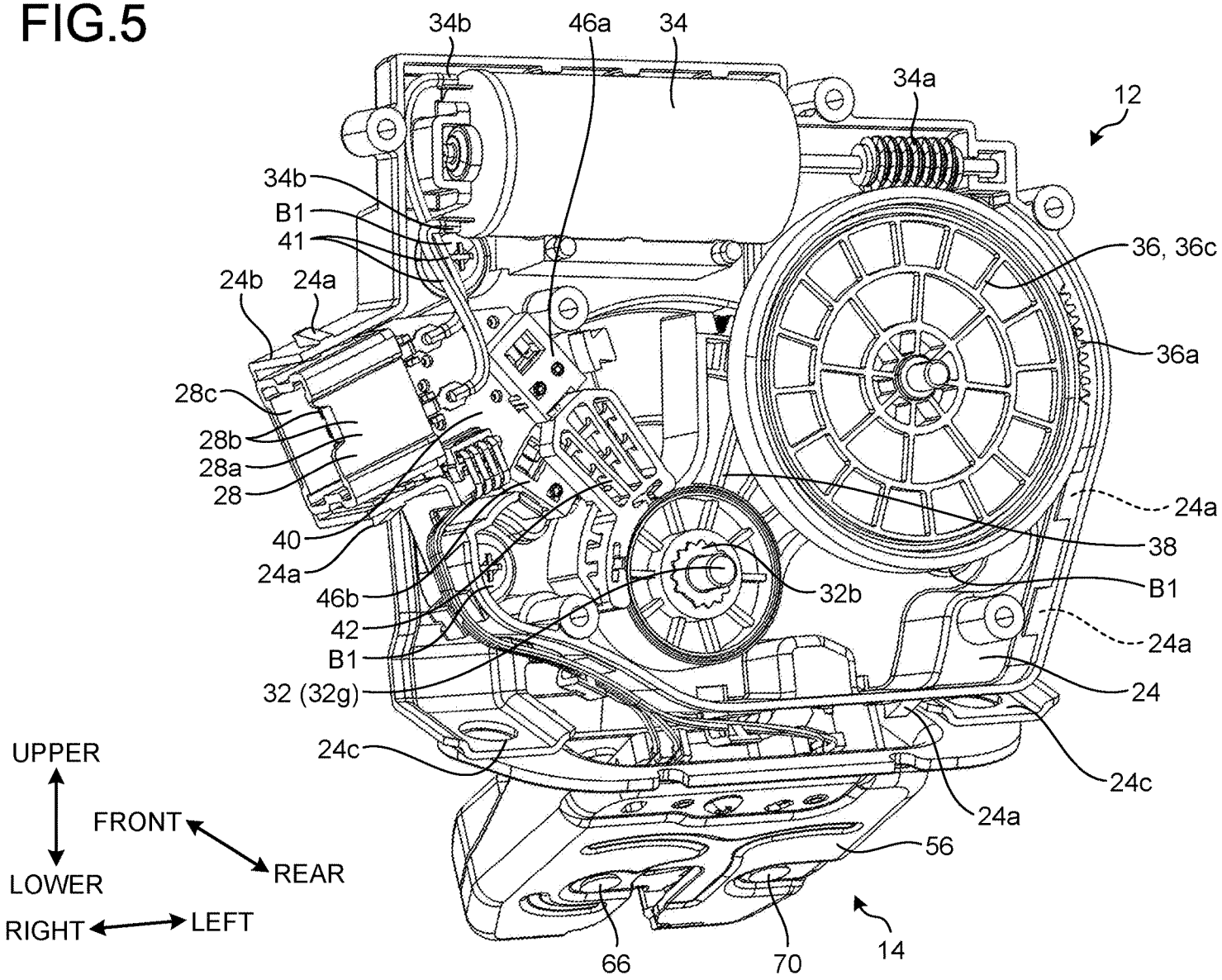
FIG. 5 is a perspective view of the inside of the motor unit when viewed from the obliquely rear side.

FIG. 4 is a perspective view of the inside of the motor unit 12 when viewed from the obliquely front side. FIG. 5 is a perspective view of the inside of the motor unit 12 when viewed from the obliquely rear side. In FIG. 4, the front housing 24 is omitted, and in FIG. 5, the rear housing 26 is omitted so that the inside of the motor unit 12 can be viewed. In FIG. 5, the latch unit 14 is also illustrated.

As illustrated in FIG. 4 and FIG. 5, the motor unit 12 includes the output shaft 32, a motor (electric component) 34, a screw (first stage gear) 34*a* provided on the rotating shaft of the motor 34, a relay gear 36, a sector gear 38, the coupler 28, and a plate assembly 40 to which the coupler 28 is fixed.

The motor 34 is disposed at the uppermost position such that the rotating shaft is placed horizontally. A pair of terminals 34*b* of the motor 34 are linked to the coupler 28 via a motor conductor 41, and the applied polarity is reversed under the action of the control unit, and the rotating shaft is rotated in the normal direction and in the reverse direction.

The relay gear 36 is provided below the rotating shaft of the motor 34, and includes large diameter teeth 36*a* having a larger number of teeth and small diameter teeth 36*b* having a smaller number of teeth. In the illustration, the large diameter teeth 36*a* is simplified. The center shaft of the relay gear 36 is rotatably supported by the front housing 24 and the rear housing 26. Because the large diameter teeth 36*a* are meshed with the screw 34*a*, the relay gear 36 is driven and decelerated under the rotating action of the screw 34*a*.

The sector gear 38 is provided obliquely below the relay gear 36, and includes outer peripheral teeth 38*a*. The rotation center of the sector gear 38 is provided such that the sector gear 38 is relatively unrotatable with respect to the output shaft 32, by spline teeth 32*b* (see FIG. 5). In the illustration, the outer peripheral teeth 38*a* is simplified. The output shaft 32 is rotatably supported by a reinforcement shaft support hole 26*b* (see FIG. 2) of the rear housing 26, and a reinforcement shaft support hole 24*d* (see FIG. 3) of the front housing 24. The output shaft 32 is also rotatably supported by the first metal bracket 16 and the second metal bracket 18. Consequently, the output shaft 32 is stable.

The outer peripheral teeth 38*a* of the sector gear 38 are meshed with the small diameter teeth 36*b* of the relay gear 36. Thus, the sector gear 38 and the output shaft 32 are driven and decelerated under the rotating action of the relay gear 36. The relay gear 36 and the sector gear 38 are relatively large components in the motor unit 12. However, the relay gear 36 and the sector gear 38 are made of resin, and are light in weight. The relay gear 36 and the sector gear 38 may be partly made of metal. The weight of the relay gear 36 can be reduced if at least the large diameter teeth 36*a* and a disk 36*c* that supports the large diameter teeth 36*a* are made of resin. The weight of the sector gear 38 can be reduced if at least the outer peripheral teeth 38*a* and a fan-shaped plate 38*b* that supports the outer peripheral teeth 38*a* are made of resin. In the door lock device 10, the relay gear 36 and the sector gear 38 are two stages of speed reduction gears. The relay gear 36 and the sector gear 38 reduce the rotation speed of the screw 34*a*, which is a first stage gear, and transmit the resultant rotation to the output shaft 32. It is possible to reduce the weight of the door lock device 10 if at least one of the speed reduction gears is made of resin.

The coupler 28 is formed in a receptacle shape, and has a plurality of male pins (terminals) 28*b* provided inside a coupler wall 28*a*. The coupler wall 28*a* has a rectangular shape when viewed from the fitting direction. An opening 28*c* of the coupler wall 28*a* is oriented obliquely downward. A rubber projection 28*d* is fixed (for example, adheres) to the front surface of the coupler wall 28*a*.

A part of the front housing 24 forms a cover 24*b* that covers the upper and lower surfaces and the front surface of the coupler 28. A perforated pedestal 24*c* is formed on each of the right and left ends of the lower portion of the front housing 24. A part of the rear housing 26 forms a cover 26*d* that covers the rear side of the coupler wall 28*a*. The cover 24*b* and the cover 26*d* form a coupler cover 39 (see FIG. 1) that covers the sides of the coupler 28. In this manner, the coupler cover 39 is formed as a part of the front housing 24 and the rear housing 26. Consequently, a dedicated component for covering the coupler 28 is not required.

A low peripheral wall 26*c* is provided on the entire periphery of the rear housing 26, and the peripheral wall 26*c* covers the entire periphery of the front housing 24. The coupler 28 is a part of the plate assembly 40.

The plate assembly 40 includes a plate 44 serving as a base member, the coupler 28, two limit switches (electric components) 46*a* and 46*b*, five pins 48, and a plurality of terminals 50. The limit switches 46*a* and 46*b* are operated by two cams, large and small, of a cam body 42, according to the rotation angle of the sector gear 38 and the output shaft 32.

Figure 6:
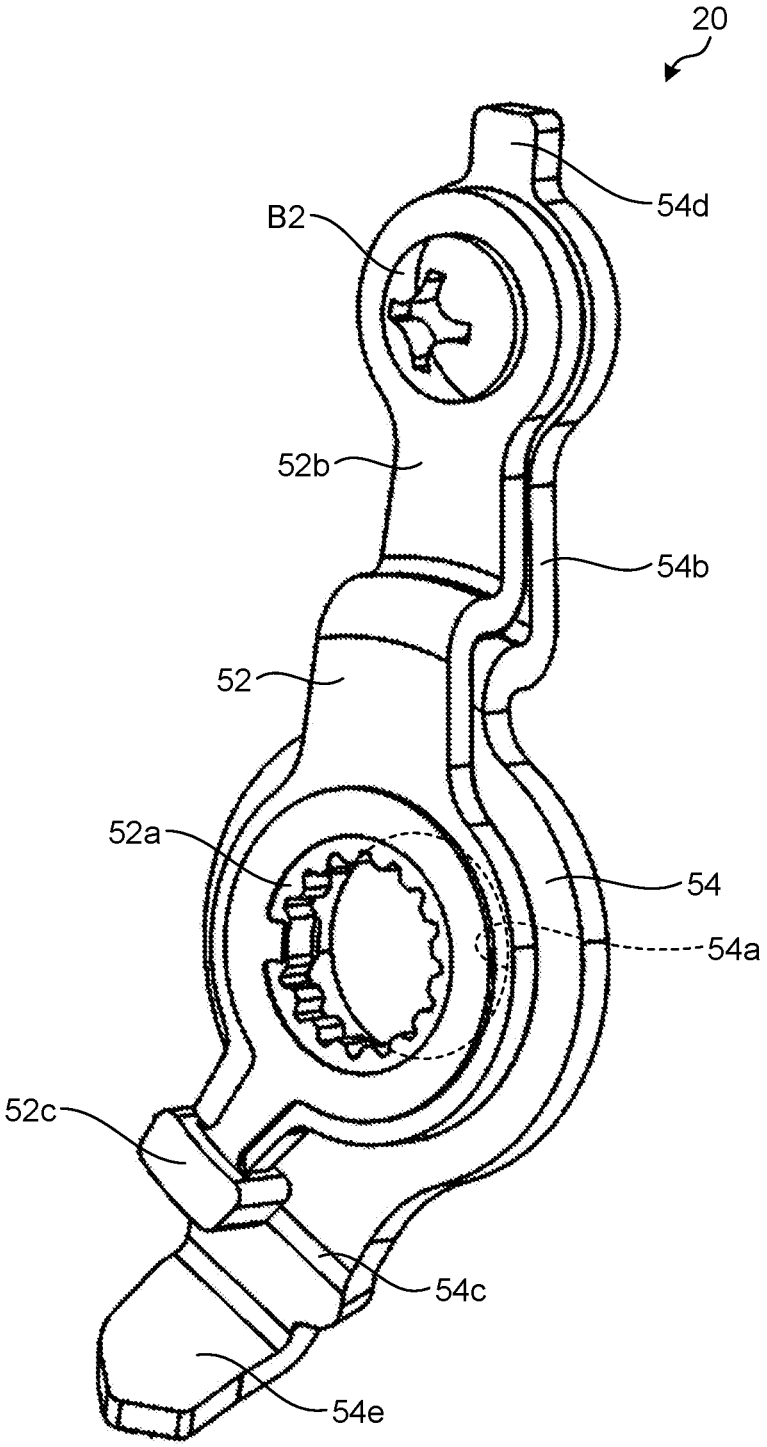
FIG. 6 is a perspective view of a lever assembly.

FIG. 6 is a perspective view of the lever assembly 20. The lever assembly 20 includes an emergency lever 52, an output lever 54, and a bolt (fixture) B2 that connects the emergency lever 52 and the output lever 54. The emergency lever 52 is provided on the near side of the output lever 54. The emergency lever 52 and the output lever 54 are disposed with substantially no gap interposed therebetween.

The emergency lever 52 includes a spline 52*a*, an arm 52*b* that extends upward, and a small lever 52*c* at the lower part. A hole through which the bolt B2 is to be inserted is provided near the tip end of the arm 52*b*. The emergency lever 52 is unrotatably connected to the output shaft 32, when the spline 52*a* is meshed with spline teeth 32*a* (see FIG. 4) provided near the tip end of the output shaft 32.

The output lever 54 includes a hole 54*a* coaxial with the spline 52*a*, an arm 54*b* that extends upward, a lever 54*c* at the lower part, and a small projection 54*d* that projects from the top part of the arm 54*b*. A screw hole into which the bolt B2 is screwed is provided on the upper portion of the arm

54*b*. The lever 54*c* is an operation part of the latch unit 14, and includes a tip end action part 54*e* bent by 90 degrees toward the near side.

The bolt B2 that has passed through the hole of the arm 52*b* is screwed into the screw hole of the arm 54*b*. Consequently, the emergency lever 52 and the output lever 54 are fastened. The hole 54*a* has a slightly larger diameter than that of the output shaft 32 to be fitted therewith. Consequently, the output lever 54 does not receive driving force directly from the output shaft 32, but is unrotatably connected with the output shaft 32 with the emergency lever 52 and the bolt B2 interposed therebetween. Thus, if the motor 34 does not move for some reason (for example, loss of power supply), it is possible move the output lever 54 manually as an emergency operation, by removing the bolt B2. When the small projection 54*d* at the upper end is manually moved, the output lever 54 is swingable. As illustrated in FIG. 1, the small projection 54*d* is exposed, and is placed at a position easily operable from the front.

Returning to FIG. 3, the open lever 22 includes a support shaft 22*a* at the upper side, a main lever 22*b* that projects downward, a small lever 22*c* that projects obliquely downward, and a torsion spring 22*d* provided around the support shaft 22*a*. The torsion spring 22*d* elastically energizes the entire open lever 22 counterclockwise. The main lever 22*b* is an operation part of the latch unit 14, and includes a tip end action part 22*e* bent by 90 degrees toward the near side. The tip end of the support shaft 22*a* is fitted into a hole 16*c* of the first metal bracket 16, and is processed such that the tip end part thereof spreads in a flange shape so as to be provided with falling prevention. Consequently, the support shaft 22*a* rotatably supports the entire open lever 22.

Figure 7:
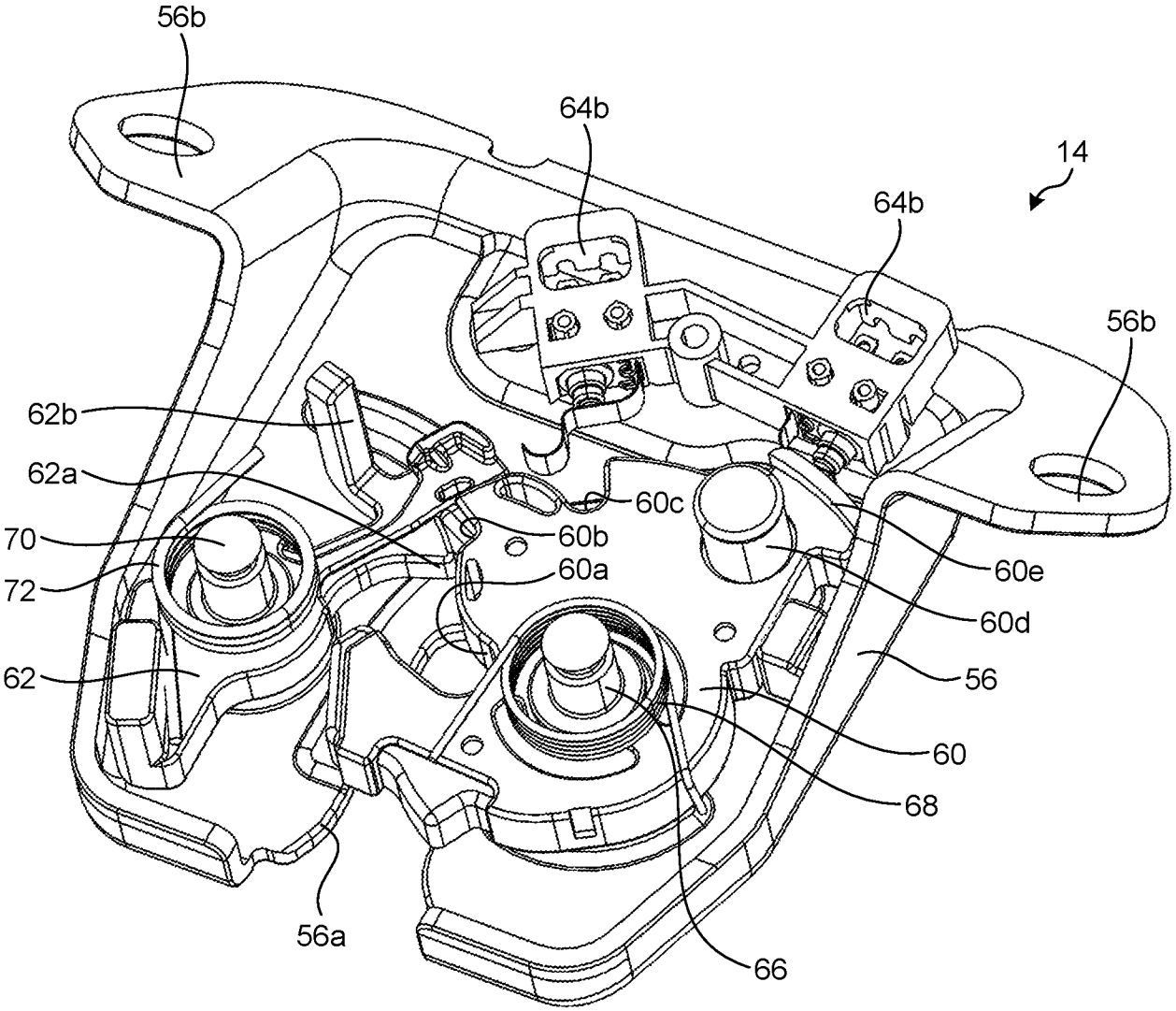
FIG. 7 is a perspective view of the inside of a latch unit.

Next, the latch unit 14 will be described. FIG. 7 is a perspective view of the inside of the latch unit 14. In the latch unit 14, an upper case 58 (see FIG. 1) covers the upper part of a third metal bracket 56 serving as a base. However, in FIG. 7, the upper case 58 is omitted so that the inside of the latch unit 14 can be viewed.

As illustrated in FIG. 7, the third metal bracket 56 is formed in a shallow box shape, and includes a striker groove 56*a* that is opened forward, and a perforated pedestal 56*b* that projects horizontally. The perforated pedestal 56*b* is fastened to a vehicle together with the first metal bracket 16 by the bolt B0 (see FIG. 3). The striker groove 56*a* is a groove into which the striker S (see FIG. 1) enters.

A latch 60, a ratchet 62, and two limit switches (electric components) 64*a* and 64*b* are provided in the third metal bracket 56. The third metal bracket 56 is made of metal, can stably and rotatably support the ratchet 62 and the latch 60, and can be fastened to the back door together with the perforated pedestal 56*b*. Consequently, it is possible to reduce the number of fastening locations and space, and thus the use of the third metal bracket 56 is reasonable.

The latch 60 is rotatably supported by a latch shaft 66, and is elastically energized counterclockwise, by a torsion spring 68 provided around the latch shaft 66. The latch 60 includes a holding notch 60*a* that holds the striker S, a full latch engagement concave part 60*b*, a half latch engagement concave part 60*c*, a cam 60*e*, and a latch lever 60*d*. The full latch engagement concave part 60*b* is provided at a vicinity of an opening part of the holding notch 60*a*. The half latch engagement concave part 60*c* is formed at a position slightly closer clockwise than the full latch engagement concave part 60*b*. The cam 60*e* is formed at a position further closer clockwise than the half latch engagement concave part 60*c*. The latch lever 60*d* is formed in a columnar shape, and is provided upright from the base part of the cam 60*e*.

The ratchet 62 is rotatably supported by a ratchet shaft 70, and is elastically energized clockwise, by a torsion spring 72 provided around the ratchet shaft 70. The ratchet 62 includes an engaging claw 62*a* placed at the rear side of the striker groove 56*a*, and a ratchet lever 62*b* that is provided upright between the ratchet shaft 70 and the engaging claw 62*a*.

The limit switches 64*a* and 64*b* are provided side by side at the rearmost area in the third metal bracket 56. The limit switch 64*a* is operated by the cam 60*e*, when the latch 60 is at a half latch position. The limit switch 64*b* is operated by the cam 60*e*, when the latch 60 is at a full latch position (position illustrated in FIG. 7). The limit switches 64*a* and 64*b* are connected to the terminals 50 (see FIG. 4) by a harness 74 (see FIG. 2). The limit switches 64*a* and 64*b* and the harness 74 can be arranged from the rear side of the door lock device 10 (see FIG. 2). The harness 74 is arranged along the side surface of the door lock device 10 by a plurality of harness stoppers 26*e*.

The assembly order is as follows. First, the limit switches 64*a* and 64*b* are assembled to the latch unit 14. Then, the harness 74 is arranged along the side surface of the door lock device 10, and the tip end part of the harness 74 is assembled to the plate assembly 40. Next, the front housing 24 and the rear housing 26 are attached.

Returning to FIG. 1 and FIG. 3, the upper case 58 is a resin material that forms the housing of the latch unit 14 with the third metal bracket 56. The upper case 58 includes a striker groove 58*a*, and shallow concave parts 58*b* and 58*c* provided on the right and left upper surfaces with the striker groove 58*a* interposed therebetween. The striker groove 58*a* forms an area where the striker S enters, with the striker groove 56*a* described above. The concave parts 58*b* and 58*c* are formed into shapes such that two lower end projection pieces 17*g* and 17*g* of the first metal bracket 16 are fitted therein. The upper end parts of the latch shaft 66 and the ratchet shaft 70 slightly project from shaft support holes 17*ga* (see FIG. 3) provided on the lower end projection pieces 17*g*. Moreover, the tip end parts of the latch shaft 66 and the ratchet shaft 70 are processed so as to spread in a flange shape, and are provided with falling prevention in a rotatable manner.

Furthermore, as illustrated in FIG. 2, the lower end parts of the latch shaft 66 and the ratchet shaft 70 project slightly from the holes provided on the bottom surface of the third metal bracket 56. Still furthermore, the tip end parts of the latch shaft 66 and the ratchet shaft 70 are made to spread in a flange shape so to be provided with falling prevention. In this manner, the latch shaft 66 and the ratchet shaft 70 are fitted into the holes of the first metal bracket 16 and the third metal bracket 56, and are processed such that the end parts are provided with falling prevention in a rotatable manner. Consequently, the latch shaft 66 and the ratchet shaft 70 stably and rotatably support the latch 60 and the ratchet 62. In this manner, the first metal bracket 16 and the third metal bracket 56 can be used as bearing members for the ratchet shaft 70 and the latch shaft 66.

Figure 8:
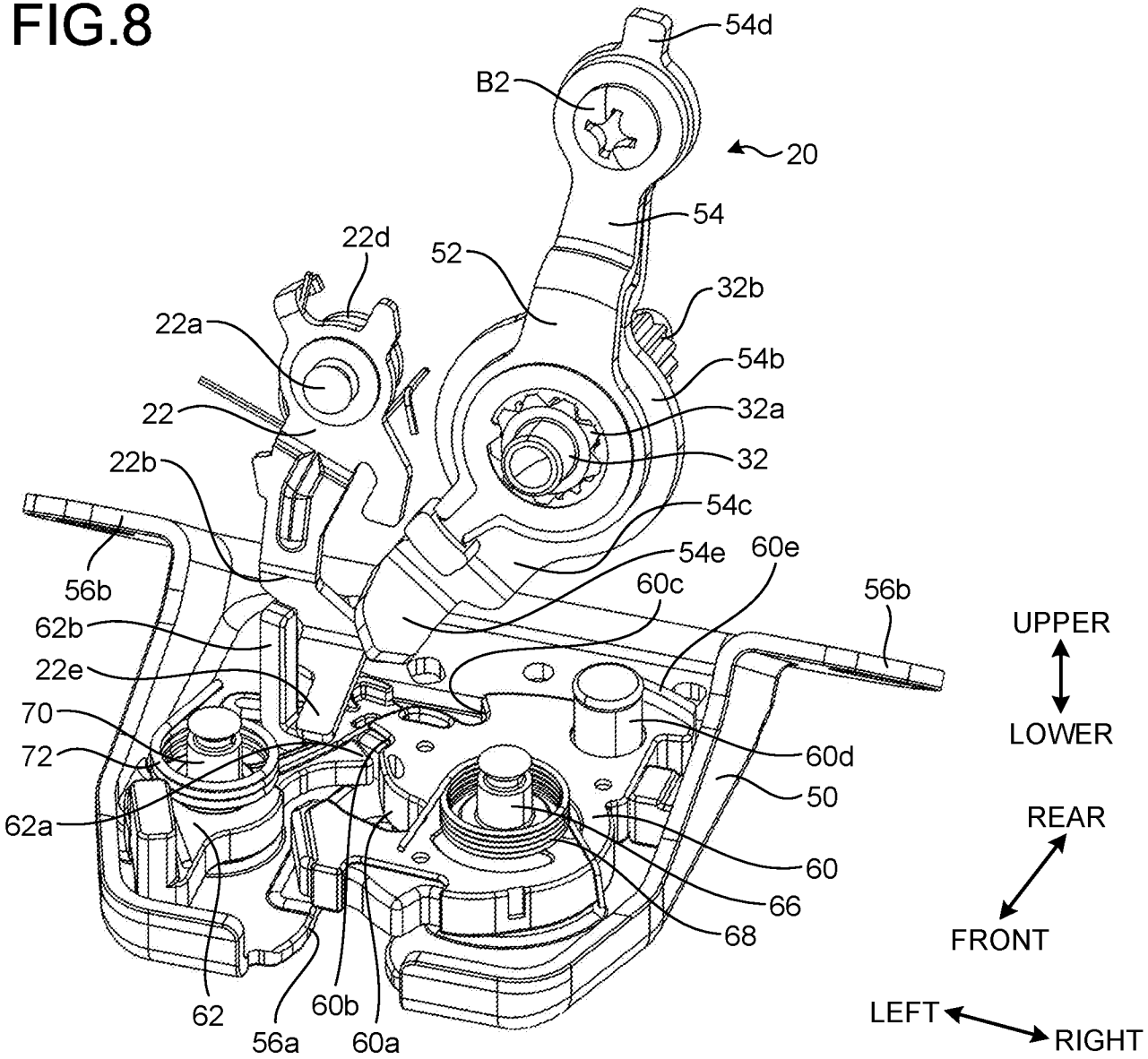
FIG. 8 is a perspective view of the inside of the latch unit, the lever assembly, and an open lever.

FIG. 8 is a perspective view of the inside of the latch unit 14, the lever assembly 20, and the open lever 22. In FIG. 8, illustrations of the limit switches 64*a* and 64*b* are omitted to avoid complication.

As illustrated in FIG. 8, the lever assembly 20 is disposed on the obliquely upper rear side of the latch shaft 66. The tip end action part 54*e* (hereinafter, referred to as a lever 54*e*) of the output lever 54 can act on the left surface of the latch lever 60*d*, and can act on the right surface of the main lever 22*b*. The open lever 22 is disposed on the obliquely upper rear side of the ratchet shaft 70, and the tip end action part 22*e* of the open lever 22 can act on the right surface of the ratchet lever 62*b*.

When the back door is opened, the latch 60 is in a predetermined opened state, and the holding notch 60*a* is opened toward the front along the striker groove 56*a*. As the back door is closed, the striker S enters the striker groove 56*a*, and is fitted into the holding notch 60*a* to turn the latch 60 clockwise. When the latch 60 is turned to the half latch position, the engaging claw 62*a* of the ratchet 62 is engaged with the half latch engagement concave part 60*c*, and the turning of the latch 60 counterclockwise is restricted. Moreover, the cam 60*e* operates the limit switch 64*a* (see FIG. 7).

The control unit recognizes that the limit switch 64*a* is turned ON, rotates and drives the motor 34, turns the output shaft 32 counterclockwise (normal rotation), and moves the lever 54*e* in the right direction. The lever 54*e* presses and moves the latch lever 60*d*, and the latch 60 is turned clockwise. The striker S is then guided to the far side while being held by the holding notch 60*a*. When the back door is completely closed, the latch 60 is at the full latch position as illustrated in FIG. 7, the engaging claw 62*a* of the ratchet 62 is engaged with the full latch engagement concave part 60*b*, and the turning of the latch 60 counterclockwise is restricted. Moreover, the cam 60*e* operates the limit switch 64*b* (see FIG. 7). The control unit recognizes that the limit switch 64*b* is turned ON, rotates and drives the motor 34 in the reverse direction, and turns the output shaft 32 clockwise. Consequently, the output lever 54 is returned to a predetermined initial position.

When a button operation to open the back door is executed by a user, the control unit recognizes the fact. The control unit rotates and drives the motor 34, turns the output shaft 32 clockwise (reverse direction), and moves the lever 54*e* in the left direction. The lever 54*e* presses and moves the ratchet lever 62*b* via the open lever 22, and the ratchet 62 is turned counterclockwise. Then, the engaging claw 62*a* of the ratchet 62 is released from the full latch engagement concave part 60*b*, and the back door is unlocked. Then, the lever 54*e* is returned to the initial position.

Figure 9:
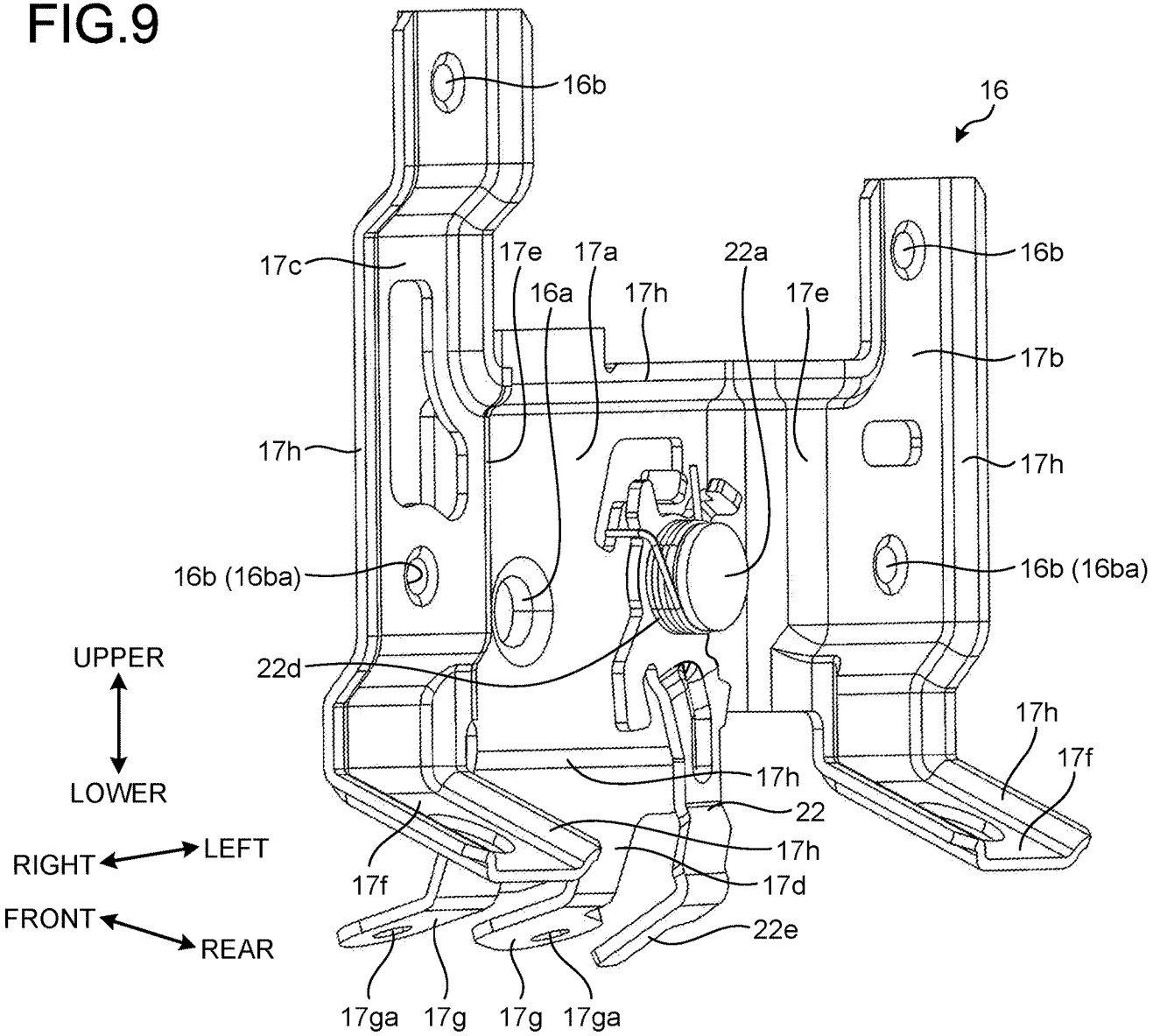
FIG. 9 is a perspective view of a first metal bracket when viewed from the obliquely rear side.

FIG. 9 is a perspective view of the first metal bracket 16 when viewed from the obliquely rear side. As illustrated in FIG. 3 and FIG. 9, the first metal bracket 16 includes a center plate 17*a* provided at the center, vertical plates 17*b* and 17*c* provided at the right and left of the center plate 17*a*, and a lower plate 17*d* provided below the center plate 17*a*. A step part 17*e* that extends in the longitudinal direction is provided between the center plate 17*a* and the vertical plates 17*b* and 17*c*. The lower plate 17*d* projects obliquely forward from the lower end of the center plate 17*a*.

A shaft support hole 16*a* and the hole 16*c* are provided on the center plate 17*a*. The shaft support hole 16*a* rotatably supports the tip end of the output shaft 32, and is provided at a substantially center of the center plate 17*a*. The shaft support hole 16*a* is formed in a horn shape the diameter of which is reduced toward the front, by press processing. As described above, the hole 16*c* rotatably supports the support shaft 22*a* (see FIG. 3) of the open lever 22.

The vertical plates 17*b* and 17*c* are provided at the right and left sides of the center plate 17*a* and extend in the vertical direction. The lower parts of the vertical plates 17*b* and 17*c* each form a perforated pedestal 17*f* that bends obliquely downward. The perforated pedestal 17*f* forms a door fixing part with the perforated pedestal 24*c* (see FIG. 5) and the perforated pedestal 56*b* (see FIG. 1) described above. The perforated pedestal 17*f* is fastened to the vehicle body together with the perforated pedestal 24*c* and the perforated pedestal 56*b* described above, by the bolt B0. Such a door fixing part for the vehicle body may also be provided in the second metal bracket 18.

The screw hole 16*b* is provided near the upper end of each of the vertical plates 17*b* and 17*c* and at a height substantially the same as that of the shaft support hole 16*a*. In other words, the screw hole 16*b* is provided at a total of four locations. As described above, the front housing 24 is fixed when the bolt B1 is screwed into the screw hole 16*b*. The two lower screw holes 16*b* are bracket interlocking parts (identified as reference numerals 16*b*a in FIG. 9), and are fastened together with the second metal bracket 18. The screw hole 16*b* is formed in a horn shape the diameter of which is reduced toward the front. Consequently, a suitable screw length is secured.

The two lower end projection pieces 17*g* that further bent from the lower plate 17*d* are formed on the lower end of the lower plate 17*d*. The shaft support hole 17*ga* is formed on each of the two lower end projection pieces 17*g*. As described above, the shaft support hole 17*ga* rotatably supports the latch shaft 66 and the ratchet shaft 70, which are provided with falling prevention. Consequently, the first metal bracket 16 may be used as a bearing material for the ratchet shaft 70 and the latch shaft 66. The first metal bracket 16 forms a peripheral wall 17*h* the edge of which is bent substantially along the entire periphery. The rigidity of the first metal bracket 16 is thus improved. For example, the first metal bracket 16 is formed by press processing a metal plate. The second metal bracket 18 and the third metal bracket 56 are formed similarly.

Figure 10:
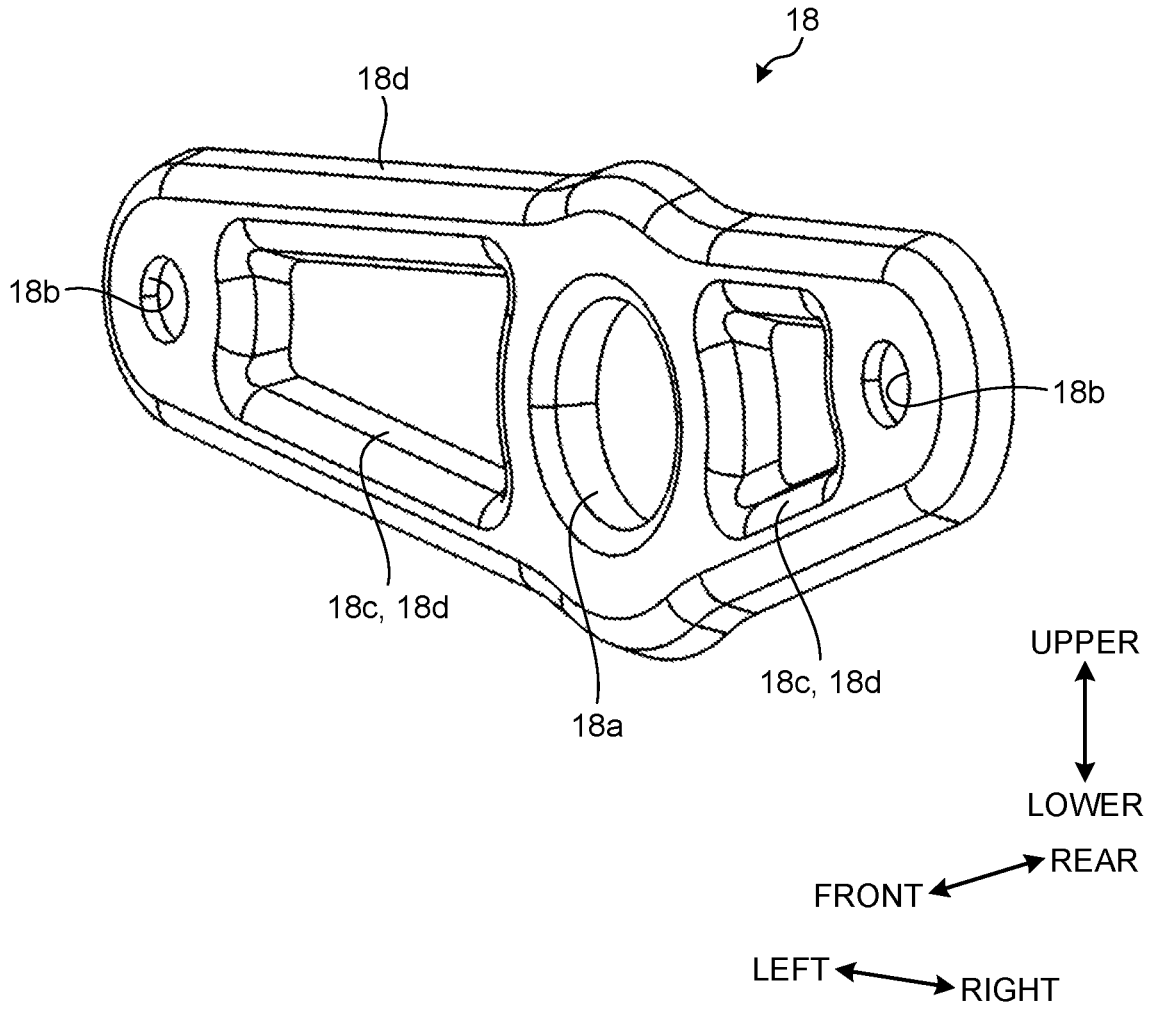
FIG. 10 is a perspective view of a second metal bracket when viewed from the obliquely front side.

FIG. 10 is a perspective view of the second metal bracket 18 when viewed from the obliquely front side. As illustrated in FIG. 10, the second metal bracket 18 is formed in a horizontally long shape. The second metal bracket 18 includes a shaft support hole 18*a* that is disposed slightly closer to the right than the center and that has a slightly large diameter. The second metal bracket 18 further includes the holes (bracket interlocking parts) 18*b* provided near the right and left ends, and two punched holes 18*c*. The shaft support hole 18*a* is a portion that rotatably supports the output shaft 32. The shaft support hole 18*a* is formed in a horn shape the diameter of which is reduced toward the rear, by press processing. The edges of the entire periphery of the second metal bracket 18 and the entire periphery of the punched holes 18*c* are bent to form a peripheral wall 18*d*. The rigidity of the second metal bracket 18 is thus improved. The two holes 18*b* have good balance, because the holes 18*b* are provided on two locations on a straight line with the shaft support hole 18*a* interposed therebetween. Consequently, the shaft support hole 18*a* can stably and rotatably support the output shaft 32.

It is to be noted that the output lever 54 connected to the output shaft 32 extends downward, and the external force transmitted from the output lever 54 is applied to the upper part of the output shaft 32. On the other hand, the two holes 18*b* of the second metal bracket 18 are provided in the horizontal direction based on the shaft support hole 18*a*. Moreover, each of the holes 18*b* is provided immediately above the perforated pedestal 17*f* serving as the door fixing part. Consequently, the second metal bracket 18 can stably receive the external force.

Figure 11:
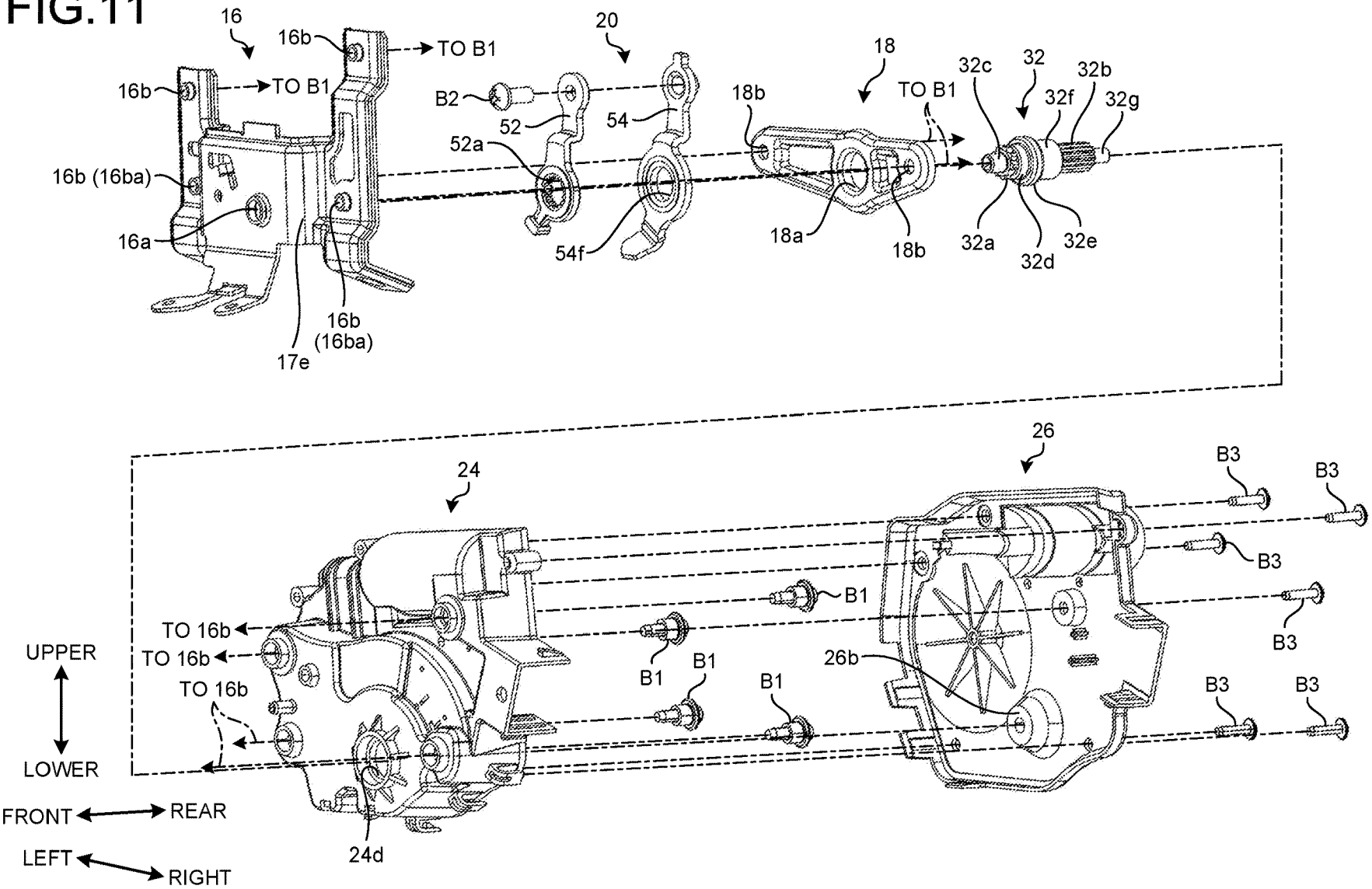
FIG. 11 is an exploded perspective view of an output shaft and members that rotatably support the output shaft.

FIG. 11 is an exploded perspective view of the output shaft 32 and members that rotatably support the output shaft 32. In addition to the locations where the spline teeth 32*a* and 32*b* described above are provided, the output shaft 32 includes a first columnar part 32*c*, a second columnar part 32*d*, a third columnar part 32*e*, a fourth columnar part 32*f*, and a fifth columnar part 32*g*. The first columnar part 32*c*, the second columnar part 32*d*, the third columnar part 32*e*, the fourth columnar part 32*f*, and the fifth columnar part 32*g* are all coaxial.

The first columnar part 32*c* is a small diameter part placed at the forefront, and is rotatably supported by the shaft support hole (first shaft support part) 16*a* of the first metal bracket 16. The second columnar part 32*d* is placed at the rear side of the first columnar part 32*c* via the spline teeth 32*a*, and has a diameter about twice as large as that of the first columnar part 32*c*. The second columnar part 32*d* is fitted to a rotation hole 54*f* of the output lever 54. The fitting tolerance between the second columnar part 32*d* and the rotation hole 54*f* is standard, and the output lever 54 is rotatable when the bolt B2 is removed.

The third columnar part 32*e* is a portion placed at the rear side of the second columnar part 32*d*, and has the largest diameter. The third columnar part 32*e* is also rotatably supported by the shaft support hole (second shaft support part) 18*a* of the second metal bracket 18. The fourth columnar part 32*f* is a portion placed at the rear side of the third columnar part 32*e*, and longest in the axial direction. The fourth columnar part 32*f* is also rotatably supported by the reinforcement shaft support hole 24*d* of the front housing 24. The fifth columnar part 32*g* is a small diameter part placed at the rearmost, and is rotatably supported by the reinforcement shaft support hole 26*b* of the rear housing 26. The spline teeth 32*b* are provided between the fourth columnar part 32*f* and the fifth columnar part 32*g*.

In this manner, the output shaft 32 is rotatably supported by the shaft support hole 16*a* serving as the first shaft support part, the shaft support hole 18*a* serving as the second shaft support part, the reinforcement shaft support hole 24*d* serving as a third shaft support part, and the reinforcement shaft support hole 26*b* serving as a fourth shaft support part from the front side in order. Consequently, the output shaft 32 is stable. In particular, the first metal bracket 16 and the second metal bracket 18 are made of metal and very rigid. Moreover, the first metal bracket 16 and the second metal bracket 18 rotatably support the output shaft 32 at different locations (in other words, the first columnar part 32*c* and the third columnar part 32*e*). Consequently, the output shaft 32 is stably and rotatably supported in a highly rigid manner.

Figure 12:
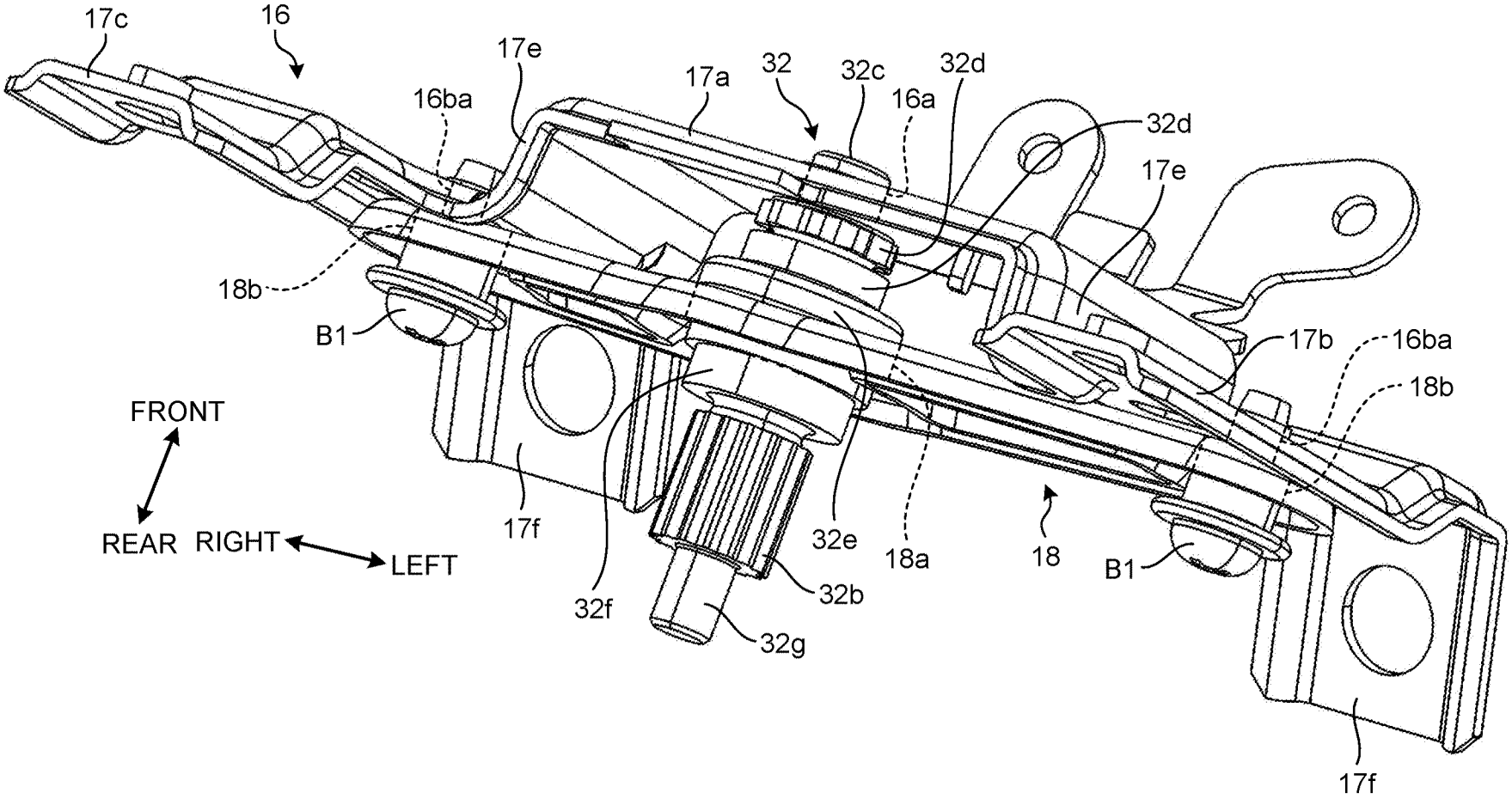
FIG. 12 is a perspective view of the output shaft, the first metal bracket, and the second metal bracket when viewed from the obliquely upward side.

FIG. 12 is a perspective view of the output shaft 32, the first metal bracket 16, and the second metal bracket 18 when viewed from the obliquely upward side. As illustrated in FIG. 12, the step part 17*e* allows the center plate 17*a* having the shaft support hole 16*a* to be disposed slightly away from the vertical plates 17*b* and 17*c* each having the screw hole 16*b*. Thus, the center plate 17*a* is suitably separated from the shaft support hole 18*a* of the second metal bracket 18. Consequently, the output shaft 32 is further stable. Despite the simple configuration, the center plate 17*a* and the step part 17*e* in the first metal bracket 16, and the second metal bracket 18 form a frame body and are very rigid. Moreover, the lever assembly 20 (see FIG. 3) and the open lever 22 are provided between the first metal bracket 16 and the second metal bracket 18. Consequently, it is possible to effectively use the space.

The third columnar part 32*e* is placed near the lever assembly 20 that transmits external force, and the diameter of which is large. Consequently, the pressure applied to the inner peripheral surface per unit area is small, and the external force can be supported without fail. Moreover, the third columnar part 32*e* is placed near the front housing 24, and relatively close to the intermediate point of the shaft length. Consequently, the third columnar part 32*e* can support the output shaft 32 with good balance.

Large force corresponding to the weight and the closing action speed of the back door may be applied to the door lock device 10. The external force is transmitted to the output shaft 32 from the striker S via the lever assembly 20. In the output shaft 32, the lever assembly 20 is connected to the second columnar part 32*d*. The second columnar part 32*d* is placed at the location interposed between the first metal bracket 16 and the second metal bracket 18, and the large external force is supported by the first metal bracket 16 and the second metal bracket 18. Consequently, it is possible to reduce the force applied to the other shaft support parts, in other words, the reinforcement shaft support hole 24*d* and the reinforcement shaft support hole 26*b*. Because most of the large external force applied to the output shaft 32 can be supported by the first metal bracket 16 and the second metal bracket 18, and because the rigidity can be maintained, the rigidity required for the front housing 24 and the rear housing 26 is small. Consequently, the front housing 24 and the rear housing 26 may be made of resin, and it is possible to reduce the weight.

The surroundings of the shaft support hole 16*a* is formed in a horn shape and projects slightly toward the front. The surroundings of the shaft support hole 18*a* is formed in a horn shape, and projects slightly toward the rear. Consequently, the distance between the front and end parts of the shaft support parts is somewhat longer, and the output shaft 32 is further stable.

As described above, in the door lock device 10, the first metal bracket 16 and the second metal bracket 18 are fixed by the bracket interlocking parts at two locations. Consequently, the output shaft 32 is stably and rotatably supported by the first shaft support part and the second shaft support part. The first metal bracket 16 and the second metal bracket 18 may also be fixed at three or more locations. Moreover, because the first metal bracket 16 is fixed to the back door with the perforated pedestal 17*f*, the output shaft 32 is rotatably supported in a highly rigid manner using the back door as the base body.

Furthermore, the front housing 24 is fastened together with the first metal bracket 16 and the second metal bracket 18 by the bracket interlocking parts. Consequently, the front housing 24 is stable. The front housing 24 and the rear housing 26 can protect the electric components such as the motor 34, and can also prevent dust from entering the electric components and other components. The front housing 24 is fastened together with the first metal bracket 16 and the second metal bracket 18 by the bracket interlocking parts. Consequently, it is possible to reduce the number of fastening locations and space, and thus the use of the front housing 24 is reasonable. The door lock device 10 may also be applied to a door other than the back door.

The present disclosure is not limited to the above embodiment, and it is obvious that various changes and modifications may be made without departing from the scope of the present disclosure.

In the present disclosure, the first metal bracket and the second metal bracket may be fixed by the bracket interlocking parts, and the output shaft may be stably and rotatably supported by the first shaft support part and the second shaft support part. Consequently, the necessary rigidity can be provided.

In the present disclosure, the resin housing may protect the motor. The resin housing may be fastened together with the bracket interlocking parts. Consequently, it is possible to reduce the number of fastening locations and space, and thus the use of the resin housing is reasonable.

In the present disclosure, at least one of the first metal bracket and the second metal bracket may include the door fixing part to be fixed to the door. Consequently, the output shaft is rotatably supported in a highly rigid manner using the door as a base body.

In the present disclosure, the third metal bracket may be made of metal which can stably and rotatably support the ratchet and the latch, and may be fastened together with the door fixing part. Consequently, it is possible to reduce the number of fastening locations and space, and thus the use of the third metal bracket is reasonable.

In the present disclosure, the output lever may be connected to the output shaft between the first metal bracket and the second metal bracket. Consequently, it is possible to effectively use the space between the first metal bracket and the second metal bracket.

In the present disclosure, the emergency lever may be unrotatably connected to the output shaft and the fixture connects the emergency lever and the output lever. Consequently, if the motor does not move for some reason, in an emergency, it is possible to move the output lever manually by removing the fixture.

In the present disclosure, the rotation shaft of the ratchet and the rotation shaft of the latch may be each locked in a rotatable state with respect to the shaft hole provided on the first metal bracket. In this manner, the first metal bracket can serve as a bearing member for the rotation shaft of the ratchet and the rotation shaft of the latch.

In the present disclosure, the bracket interlocking parts may be provided on two locations on the straight line with the second shaft support part interposed therebetween. When the bracket interlocking parts are provided at such positions, the bracket interlocking parts have good balance. Consequently, the second shaft support part can stably and rotatably support the output shaft.

In the present disclosure, at least one speed reduction gear may be made of resin. Consequently, it is possible to reduce weight.

In the door lock device according to the present disclosure, the first metal bracket and the second metal bracket are fixed by the bracket interlocking parts, and the output shaft can be stably and rotatably supported by the first shaft support part and the second shaft support part. Consequently, it is possible to reduce weight while maintaining rigidity.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A door lock device comprising:

a latch configured to hold a striker;

a ratchet configured to engage the latch at a half latch position and at a full latch position;

an output shaft configured to rotate in a normal direction and in a reverse direction by a motor;

an output lever unrotatably connected to the output shaft, the output lever being configured to move the latch from the half latch position to the full latch position when the output shaft is rotated in the normal direction, and to release an engagement of the ratchet to the latch when the output shaft is rotated in the reverse direction;

a first metal bracket including a first shaft support hole configured to rotatably support the output shaft; and a second metal bracket including a second shaft support hole configured to rotatably support the output shaft at a location different from that of the first shaft support hole, wherein the first metal bracket and the second metal bracket are fixed to each other by two or more screw holes of the first metal bracket and two or more holes of the second metal bracket.

2. The door lock device according to claim 1, further comprising:

a resin housing configured to house the motor, wherein the first metal bracket and the second metal bracket are fastened together with the resin housing by the screw holes of the first metal bracket and the holes of the second metal bracket.

3. The door lock device according to claim 1, wherein at least one of the first metal bracket and the second metal bracket includes a perforated pedestal to be fixed to the door.

4. The door lock device according to claim 2, wherein at least one of the first metal bracket and the second metal bracket includes a perforated pedestal to be fixed to the door.

5. The door lock device according to claim 3, further comprising:

a third metal bracket configured to rotatably support a rotation shaft of the ratchet and a rotation shaft of the latch, wherein the third metal bracket is fastened together with the perforated pedestal to the door.

6. The door lock device according to claim 4, further comprising:

a third metal bracket configured to rotatably support a rotation shaft of the ratchet and a rotation shaft of the latch, wherein the third metal bracket is fastened together with the perforated pedestal to the door.

7. The door lock device according to claim 1, wherein the output lever is connected to the output shaft between the first metal bracket and the second metal bracket.

8. The door lock device according to claim 1, further comprising:

an emergency lever unrotatably connected to the output shaft; and a fixture configured to connect the emergency lever and the output lever, wherein by removing the fixture, the output lever becomes rotatable with respect to the output shaft.

9. The door lock device according to claim 1, wherein the rotation shaft of the ratchet and the rotation shaft of the latch are each locked in a rotatable state with respect to a shaft hole provided on the first metal bracket.

10. The door lock device according to claim 1, wherein the screw holes of the first metal bracket and the holes of the second metal bracket are provided on two locations on a straight line with the second shaft support hole interposed therebetween.

11. The door lock device according to claim 1, further comprising:

a first stage gear provided on a rotation shaft of the motor; and one or more stages of a speed reduction gear configured to reduce speed of rotation of the first stage gear and transmit the resultant rotation to the output shaft, wherein at least one speed reduction gear is made of resin.

* * * * *